US009463662B1

(12) United States Patent
Sotolongo

(10) Patent No.: US 9,463,662 B1
(45) Date of Patent: Oct. 11, 2016

(54) PORTABLE UTILITY STORAGE APPARATUS AND ASSOCIATED USE THEREOF

(71) Applicant: Carlos Sotolongo, Torrington, CT (US)

(72) Inventor: Carlos Sotolongo, Torrington, CT (US)

( * ) Notice: Subject to any disclaimer, the term of this patent is extended or adjusted under 35 U.S.C. 154(b) by 37 days.

(21) Appl. No.: 14/613,515

(22) Filed: Feb. 4, 2015

Related U.S. Application Data

(63) Continuation-in-part of application No. 13/680,768, filed on Nov. 19, 2012, now abandoned.

(60) Provisional application No. 61/586,235, filed on Jan. 13, 2012.

(51) Int. Cl.
*A45F 5/00* (2006.01)
*B44D 3/12* (2006.01)

(52) U.S. Cl.
CPC ..... *B44D 3/126* (2013.01); *A45F 5/00* (2013.01); *A45F 2200/0575* (2013.01)

(58) Field of Classification Search
CPC ..... B44D 3/126; B44D 3/14; B44D 3/121; A45F 5/00; A45F 5/02; A45F 5/021; A45F 2200/0575
See application file for complete search history.

(56) References Cited

U.S. PATENT DOCUMENTS 4,325,503 A * 4/1982 Swinney ..... A45F 5/02 224/148.4
4,363,433 A * 12/1982 Jaques ..... B44D 3/24 206/362
4,433,801 A * 2/1984 Swinney ..... B44D 3/14 224/148.4
5,489,051 A * 2/1996 Robinson ..... A45F 5/02 206/361
5,490,618 A * 2/1996 Davidson ..... B44D 3/14 224/148.4
5,497,921 A * 3/1996 Dancyger ..... A45F 5/02 224/148.6
6,006,966 A * 12/1999 Voisin, Jr. ..... B44D 3/14 224/148.4
6,045,017 A * 4/2000 Connell ..... A45F 5/02 224/148.4
6,283,345 B1 * 9/2001 Butschat ..... A45F 5/02 224/148.4
6,719,178 B1 * 4/2004 Taylor ..... A45F 3/02 224/148.7
8,418,309 B1 * 4/2013 Williams ..... B44D 3/126 15/257.05
2002/0185509 A1 * 12/2002 Wichman ..... A45F 5/00 224/677
2003/0111497 A1 * 6/2003 Lukaris ..... A45F 5/02 224/197
2004/0195280 A1 * 10/2004 Shackelford ..... A45F 5/00 224/148.7
2011/0259891 A1 * 10/2011 Thibault ..... B44D 3/14 220/495.06
2012/0037634 A1 * 2/2012 Kiceniuk, Jr. ..... B44D 3/121 220/495.02
2014/0061275 A1 * 3/2014 Egan ..... A45F 5/021 224/665
2015/0250296 A1 * 9/2015 Dietmeyer ..... A45F 5/02 224/271
2015/0305478 A1 * 10/2015 Krol ..... A45F 3/14 224/148.6
2016/0101646 A1 * 4/2016 Kiceniuk ..... B44D 3/126 224/191

* cited by examiner

*Primary Examiner* — Corey Skurdal

(57) ABSTRACT

A portable utility storage apparatus includes a lower portion having a first receiving section, and an upper portion contiguously formed with the lower portion wherein the upper portion has a second receiving section oppositely spaced from the first receiving section. A clip is selectively and removably engaged with the upper portion in such a manner that the first receiving section and the second receiving section freely and synchronously oscillate about a fulcrum axis defined substantially perpendicular to the upper portion. A first coupling is removably attached to another one of the first receiving section and the second receiving section. Notably, a rail is removably attached to one of the first receiving section and the second receiving section. In this manner, the rail having a second coupling is interchangeably engaged with the first receiving section and the second receiving section.

15 Claims, 19 Drawing Sheets

PORTABLE UTILITY STORAGE APPARATUS AND ASSOCIATED USE THEREOF

CROSS REFERENCE TO RELATED APPLICATIONS

This application is a continuation-in-part application of U.S. patent application Ser. No. 13/680,768, filed Nov. 19, 2012 and currently pending, which claims the benefit of U.S. Provisional Application No. 61/586,235, filed Jan. 13, 2012, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

Exemplary embodiment(s) of the present disclosure relate to a portable utility storage apparatus and, more particularly, to a portable utility storage apparatus worn at a user's waist that includes a pouch which provides a ready supply of objects including but not limited to paint brushes, paint rollers, etc.

2. Prior Art

A fresh coat of paint can vastly improve or completely alter the appearance of most homes. Whether using a neutral white or eggshell color to cover scuff marks, or a vibrant and bold color, in order to change the entire design scheme of a room, homeowners and designers alike use paint as both a functional and decorative medium. Including pigments and emulsions suspended in a liquid base, paint also consists of countless compounds which are uniquely formulated to meet the various requirements of literally hundreds of thousands of applications.

Although the first paint was used in caves over 30,000 years ago, the modern paint industry became a key contributor to the US economy during the mid-1800s. It was at this time that an Ohio man by the name of D. R. Averill patented the first "ready mixed" paint and within twenty years of this patent, factories which specialized in paint production sprang up across the nation. Today, the paint industry is booming like never before. In fact, according to recent statistics compiled by the Paint and Coatings Industry Information Center, recent sales of interior and exterior house paint reached almost $17 billion and that number is steadily on the rise. With reputable companies producing quality paint at affordable prices and top designers all offering chic designer versions and unlimited color palettes, the popularity of decorating with paint should never diminish.

While paint offers consumers a creative means of decorating their homes, the process of painting is often times less than enjoyable. Scraping windows and preparing walls can all be a nuisance, but for most, the end results achieved by an attractive coat of paint far outweigh the hassles. To facilitate any particular painting task, painters have a variety of sizes and configurations of paint brushes specifically designed for the job at hand. From using a large, synthetic bristled brush for broad expanses of siding, wide trim, or garage doors to appropriating a compact, natural fiber, trim-line for working comers and narrow edges, it is essential for painters to maintain several brushes to accommodate any painting job.

Not surprisingly, when painting surface areas, the user must repeatedly dip their brush in the paint in order to keep the brush saturated and ensure a ready supply of paint on walls or trim. Unfortunately, repeatedly climbing up and down a ladder to reload a brush with paint, or walking back and forth from the designated wall one is painting to the actual paint bucket, simply in order to saturate one's paint brush, can be a tedious and time consuming endeavor, detracting from the job at hand.

Accordingly, a need remains for a portable utility storage apparatus in order to overcome prior art shortcomings. The exemplary embodiment(s) satisfy such a need by providing a portable utility storage apparatus which may be worn at a user's waist that is convenient and easy to use, lightweight yet durable in design, versatile in its applications, and designed for providing a ready supply of objects to facilitate painting without misapplication of paint on undesired areas.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a portable utility storage apparatus for supporting an object (e.g., paint, paint brush, roller brush, hammer, nails, soda can, food, etc. These and other objects, features, and advantages of the non-limiting exemplary embodiment(s) are provided by a portable utility storage apparatus includes a lower portion having a first receiving section, and an upper portion contiguously formed with the lower portion wherein the upper portion has a second receiving section oppositely spaced from the first receiving section. A clip is selectively and removably engaged with the upper portion in such a manner that the first receiving section and the second receiving section freely and synchronously oscillate about a fulcrum axis defined substantially perpendicular to the upper portion.

Notably, a rail is removably attached to one of the first receiving section and the second receiving section. In this manner, the rail is interchangeably engaged with the first receiving section and the second receiving section. Furthermore, a first coupling is removably attached to another one of the first receiving section and the second receiving section. In this manner, the first coupling is interchangeably engaged with the first receiving section and the second receiving section. Advantageously, the first coupling is spaced from the rail thereby enabling a user to separately support objects at said portable utility storage apparatus.

In a non-limiting exemplary embodiment, the lower portion includes a lower front wall and a lower rear wall contiguously formed therewith. Thus, a cavity is disposed between the lower front wall and the lower rear wall wherein the first receiving section is located proximate to the cavity. In this manner, the cavity is adapted to receive at least a portion of the object therein.

In a non-limiting exemplary embodiment, the lower portion further includes a plurality of friction-inducing members located at an anterior face of the lower rear wall such that the friction-inducing members are seated within the cavity. Such friction-inducing members may be raised protrusion, recessed depressions, randomly spaced, uniformly spaced, permanently affixed, detachable, etc. Thus, if paint is retained in the cavity, excess paint from a paint brush and/or paint roller can be selectively removed as needed.

In a non-limiting exemplary embodiment, the upper portion includes an upper rear wall extending upwardly from the lower rear wall such that the upper rear wall is disposed above the cavity. A plurality of apertures are formed in the upper rear wall and registered above the second receiving section wherein the second receiving section is located at the upper rear wall and disposed above the first receiving section relative to the cavity.

In a non-limiting exemplary embodiment, the clip is selectively and removably engaged with the apertures in such a manner that a top end of the clip folds down and over a top edge of the upper rear wall.

In a non-limiting exemplary embodiment, the portable utility storage apparatus further includes a second coupling spaced from the first coupling and attached to the rail. Notably, the second receiving section has an anterior side facing towards the first receiving section. Conversely, the second receiving section has a posterior side facing away from the first receiving section.

In a non-limiting exemplary embodiment, the second coupling is juxtaposed anterior to the upper rear wall when the rail is located at the anterior side of the second receiving section such that the rail is intercalated between the upper rear wall and the second coupling.

In a non-limiting exemplary embodiment, the second coupling is juxtaposed posterior to the upper rear wall when the rail is located at the posterior side of the second receiving section such that the rail is intercalated between the upper rear wall and the second coupling.

In a non-limiting exemplary embodiment, the first receiving section includes a groove integrally formed with the lower portion. Such a groove is offset from a plane of the lower front wall. A plurality of lower linear guide shoulders are spaced apart at lateral edges of the groove wherein the lower linear guide shoulders extend medially towards a center of the groove.

In a non-limiting exemplary embodiment, the first coupling includes a plate having a planar central region, and a first magnet coupled to the planar central region wherein the plate includes a plurality of deformable flanges laterally spaced at opposed edges thereof. Such deformable flanges are registered adjacent to opposed ends of the first magnet wherein the deformable flanges are selectively offset from the planar central region and registered along mutually exclusive paths, respectively, and thereby registered non-planar to the planar central region. Advantageously, such deformable flanges are frictionally engaged with the lower linear guide shoulders when the plate is seated at the groove.

In a non-limiting exemplary embodiment, the second receiving section includes a first wall located at the anterior side thereof and angularly extends upwards and away from the upper rear wall. A second wall is located at the posterior side thereof and angularly extends upwards and away from the upper rear wall. A channel is formed between the first wall and the second wall. A planar divider member is interfitted within the channel such that the anterior side of the second receiving section is bifurcated from the posterior side of the second receiving section. In this manner, the rail is maintained at a substantially stable position when intermeshed at both the anterior side and posterior side of the second receiving section.

In a non-limiting exemplary embodiment, the rail includes a body having a bottom edge and a top edge opposed therefrom. A plurality of juxtaposed parallel slits extend upwardly from the bottom edge of the body, and a plurality of juxtaposed notches extend downwardly from the top edge of the body. Notably, the second coupling is intermediately positioned between the parallel slits.

In a non-limiting exemplary embodiment, the second coupling faces towards the cavity when the parallel slits are engaged with the first wall and the rail is registered anterior to the divider member such that the notches are positioned at the anterior side of the second receiving section.

In a non-limiting exemplary embodiment, the second coupling faces away from the cavity when the parallel slits are engaged with the second wall and the rail is registered posterior to the divider member such that the notches are positioned at the posterior side of the second receiving section.

In a non-limiting exemplary embodiment, the second coupling includes a second magnet.

The present disclosure further includes a method of utilizing a portable utility storage apparatus for supporting an object thereat. Such a method includes the steps of: providing a lower portion has a first receiving section; providing an upper portion contiguously formed with the lower portion wherein the upper portion has a second receiving section oppositely spaced from the first receiving section; providing and removably attaching a rail to one of the first receiving section and the second receiving section; providing and removably attaching a first coupling to another one of the first receiving section and the second receiving section such that the first coupling is spaced from the rail; providing a clip; selectively and removably engaging the clip with the upper portion; and freely and synchronously oscillating the first receiving section and the second receiving section about a fulcrum axis defined substantially perpendicular to the upper portion.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
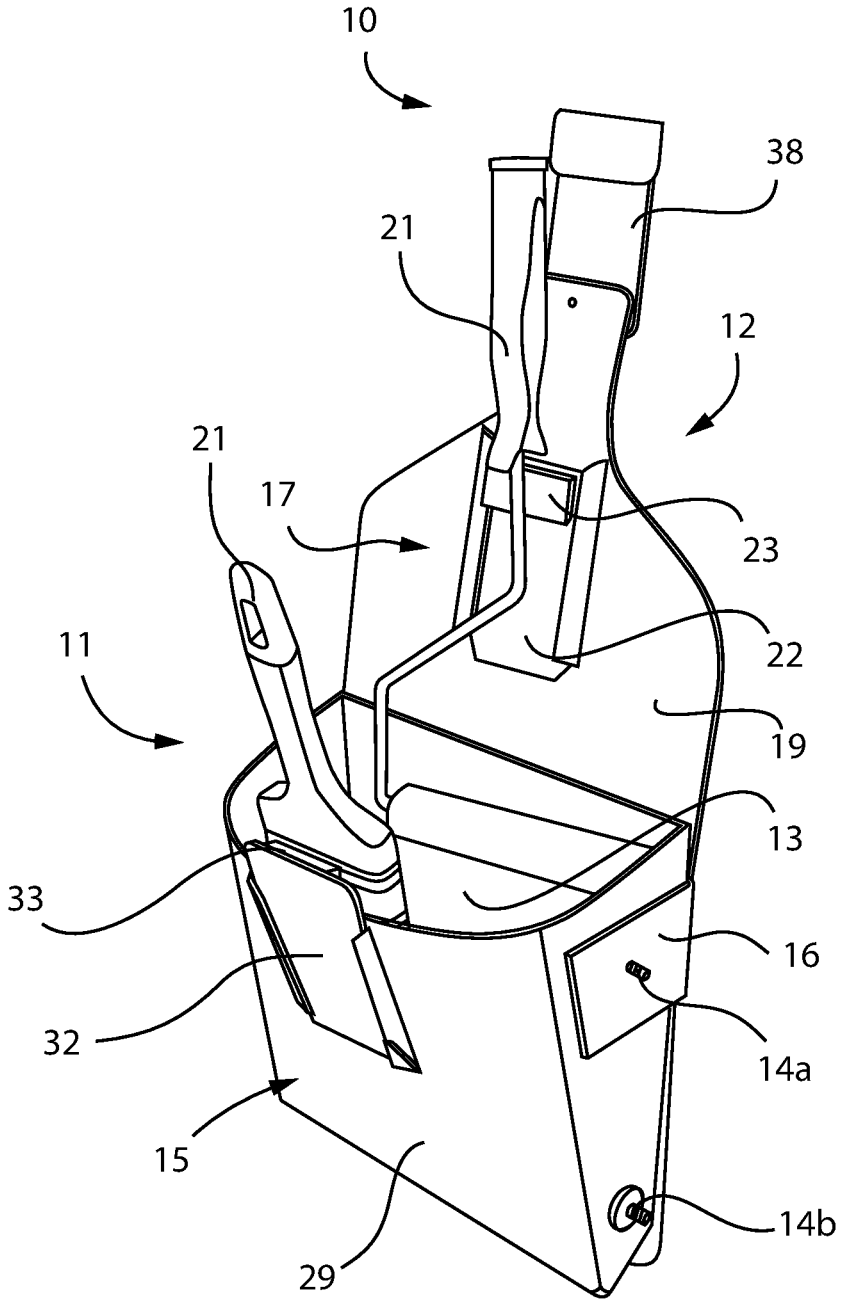
FIG. 1 is a perspective view showing a portable utility storage apparatus, in accordance with the non-limiting exemplary embodiment(s)
Figure 2:
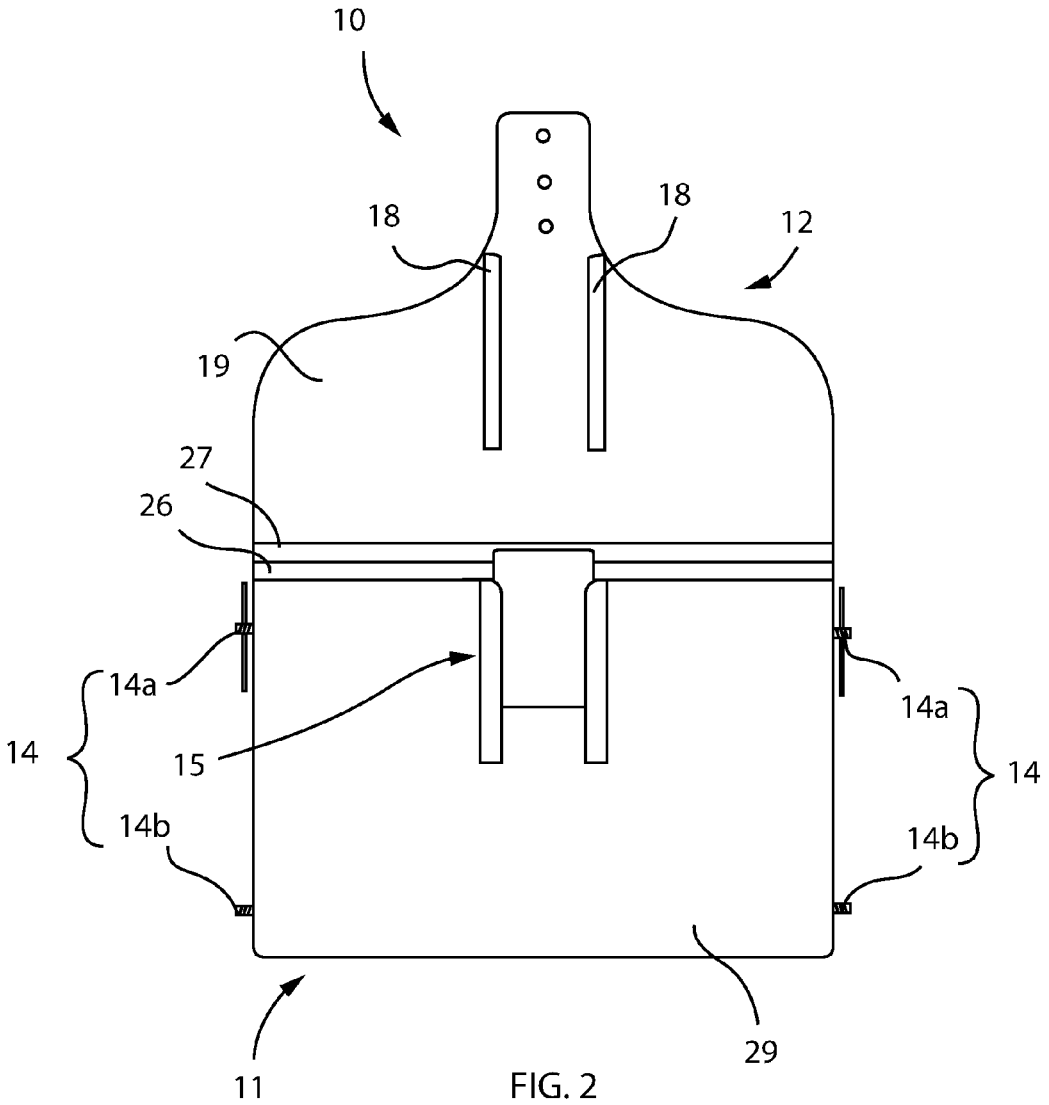
FIG. 2 is a front plan view of the apparatus shown in FIG. 1.
Figure 3:
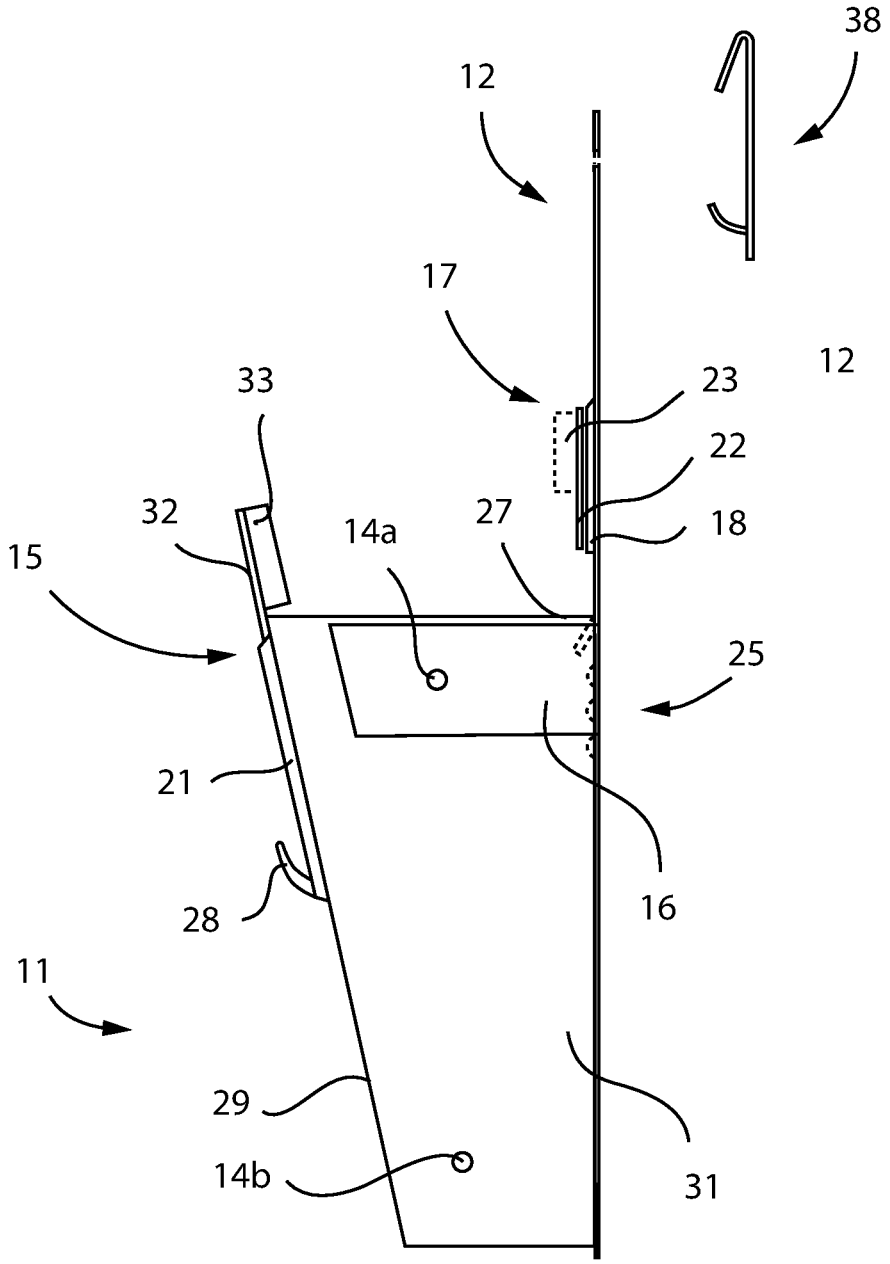
FIG. 3 is a side elevational view of the apparatus shown in FIG. 1 wherein the swivel belt clip is detached from the upper and lower portions.
Figure 4:
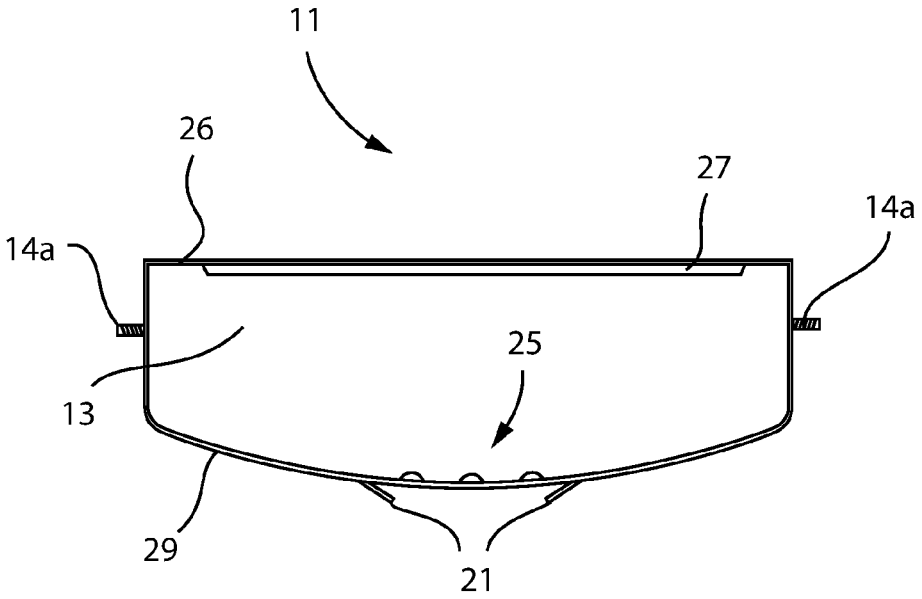
FIG. 4 is a top plan view of the lower portion showing the protrusions and paint scraper attached to the lower portion.
Figure 5:
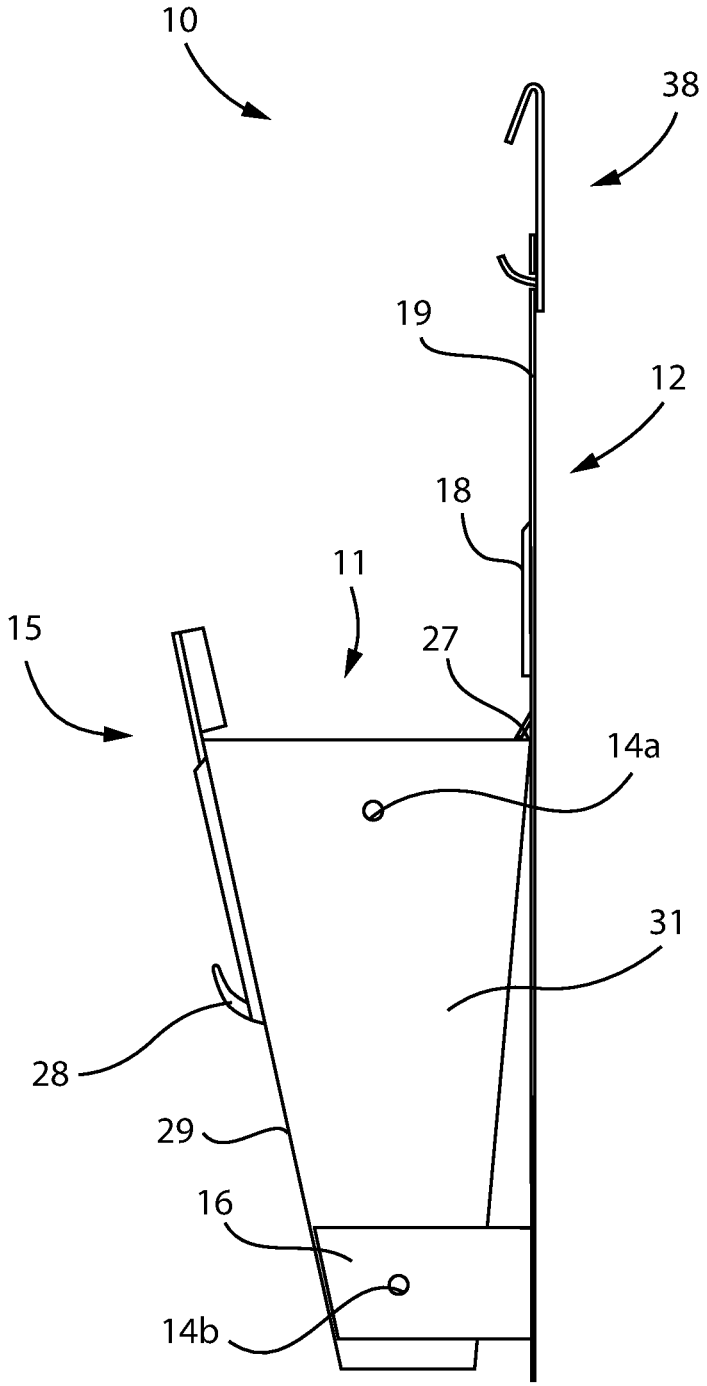
FIG. 5 is a side elevational view of the apparatus shown in FIG. 1 wherein the swivel belt clip is attached to the upper portion.
Figure 6:
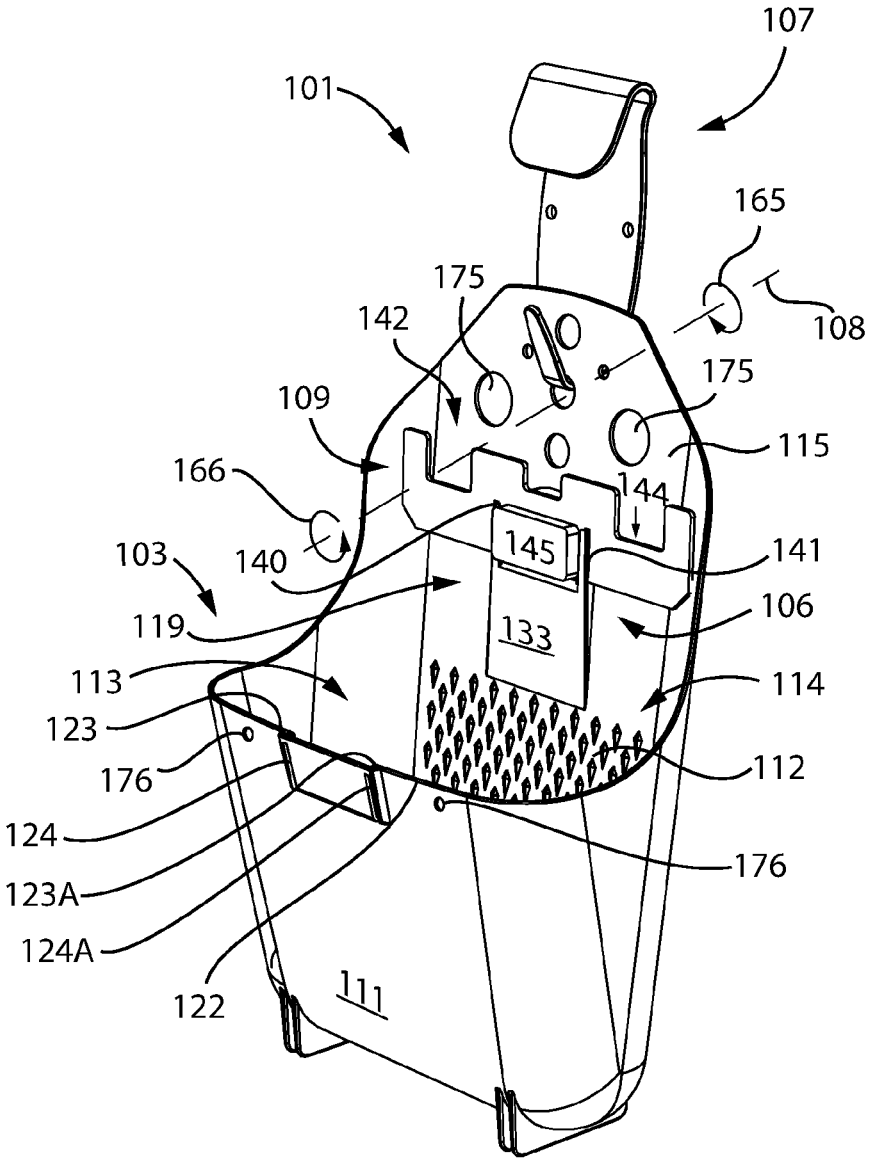
FIG. 6 is a perspective view showing a non-limiting exemplary embodiment of a portable utility pocket apparatus wherein a rail and a second coupling are removably seated at an anterior side of a second receiving section.
Figure 7:
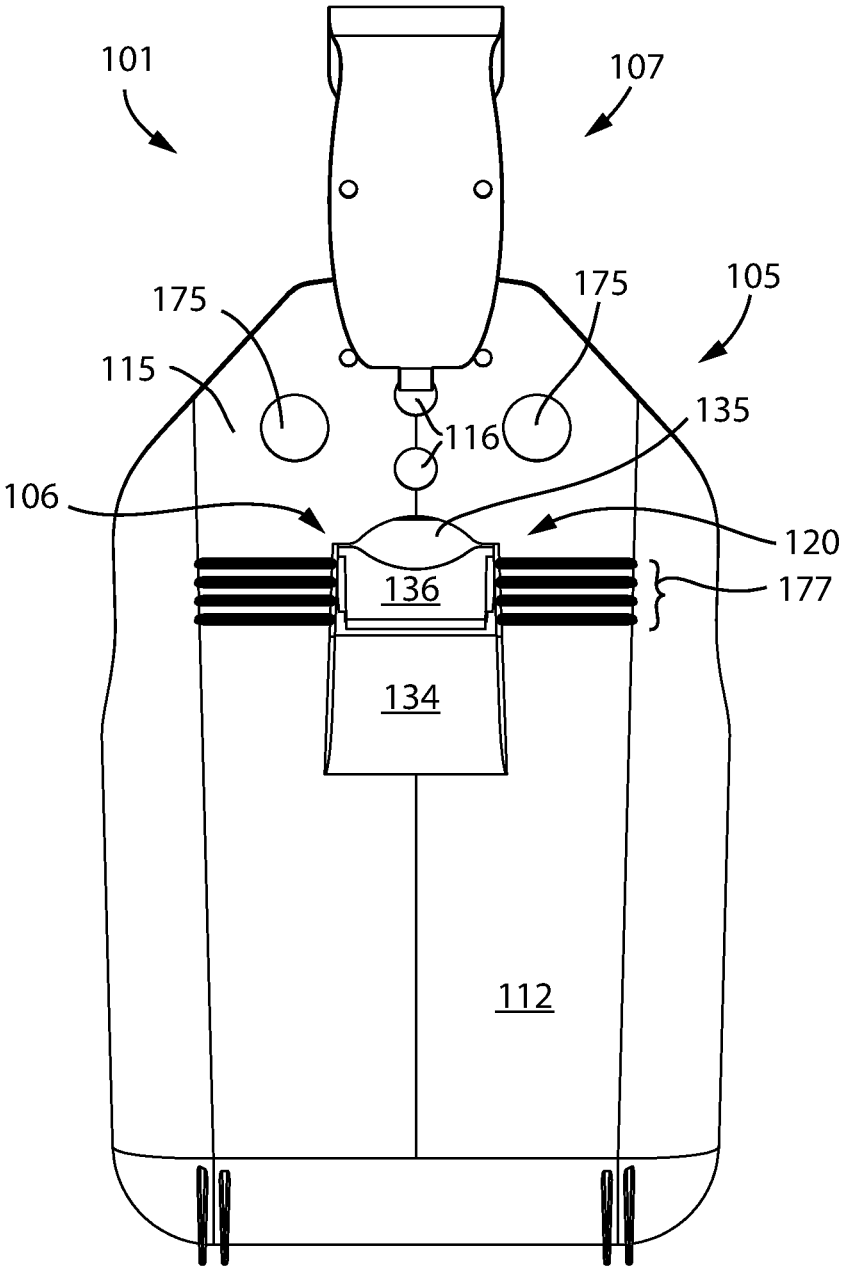
FIG. 7 is rear-elevational view of the embodiment shown in FIG. 6.
Figure 8:
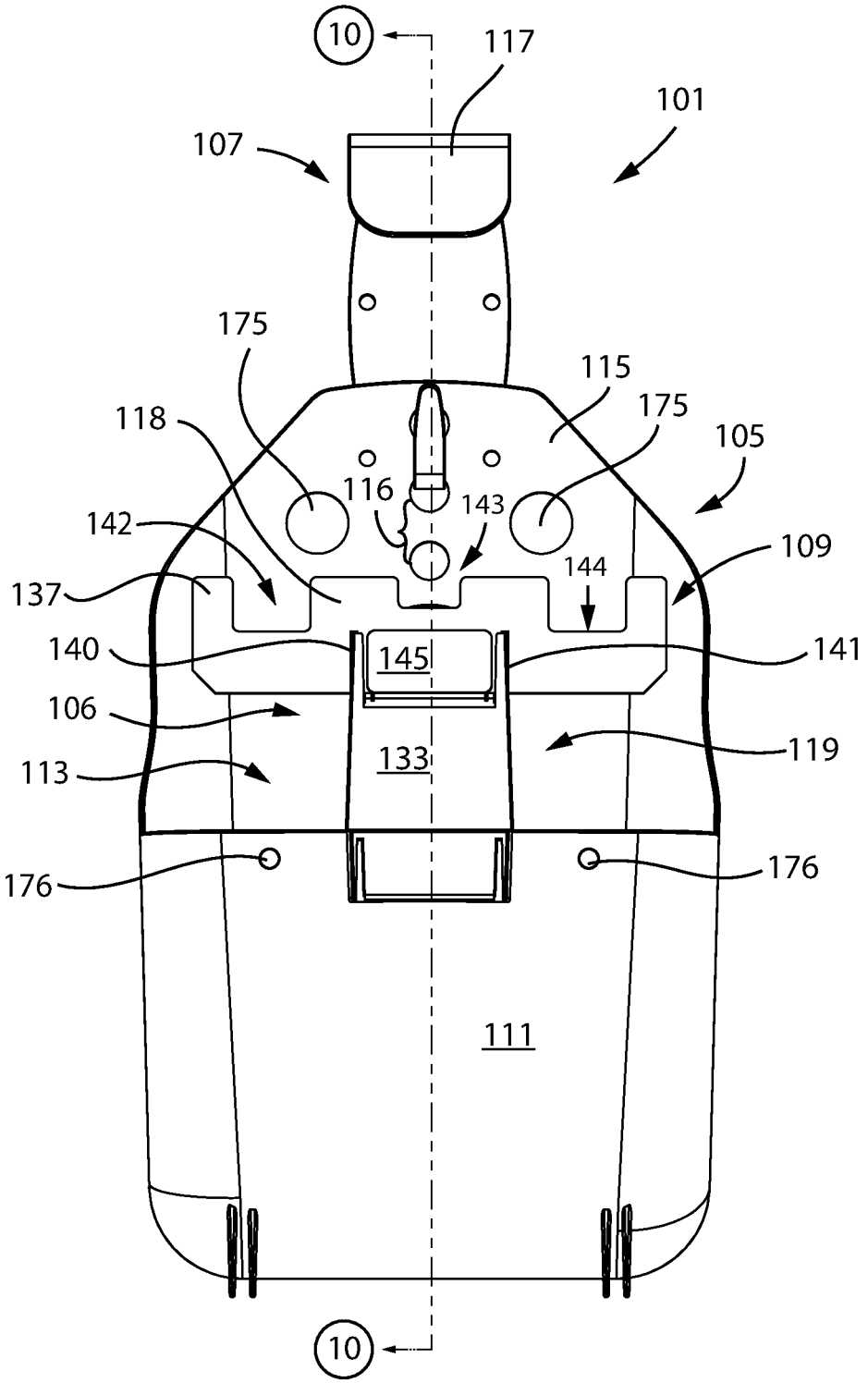
FIG. 8 is a front-elevational view of the embodiment shown in FIG. 6.
Figure 9:
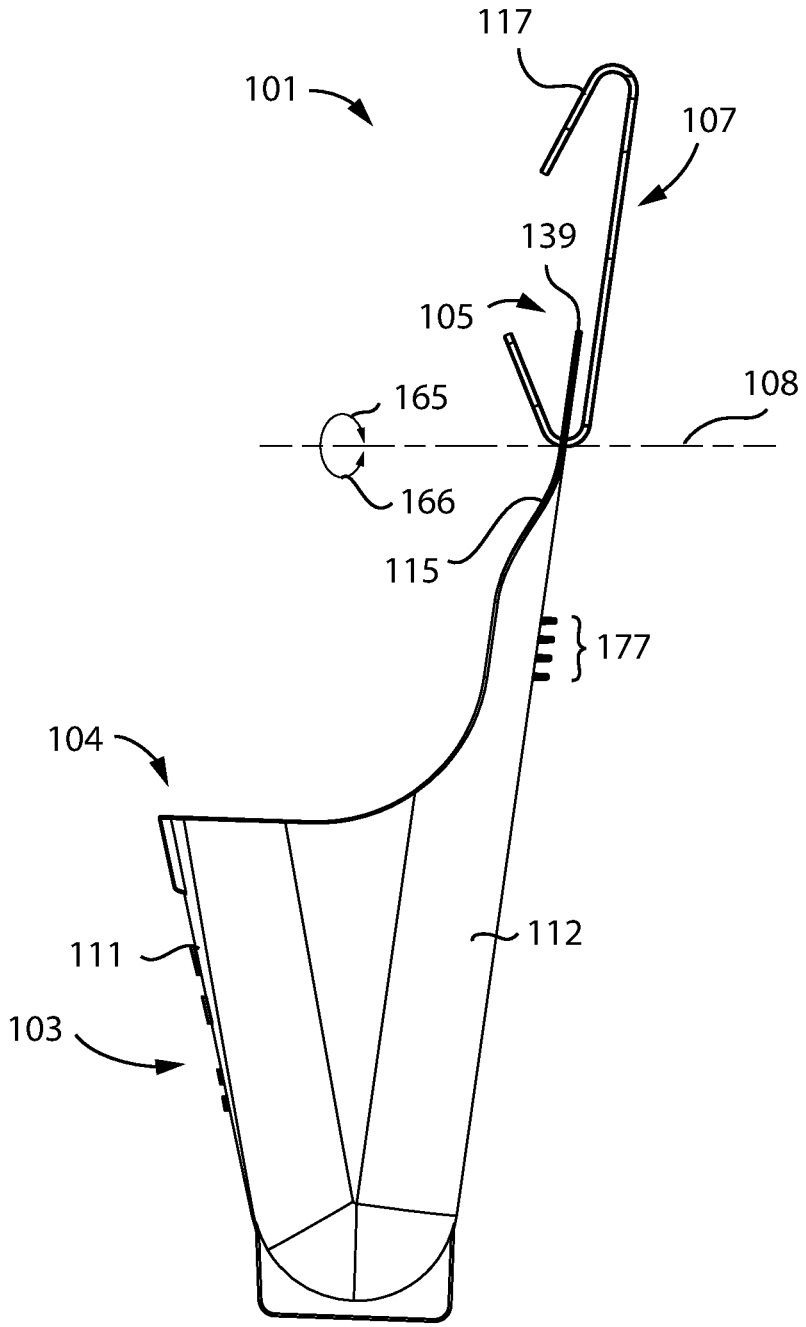
FIG. 9 is a side-elevational view of the embodiment shown in FIG. 6.
Figure 10:
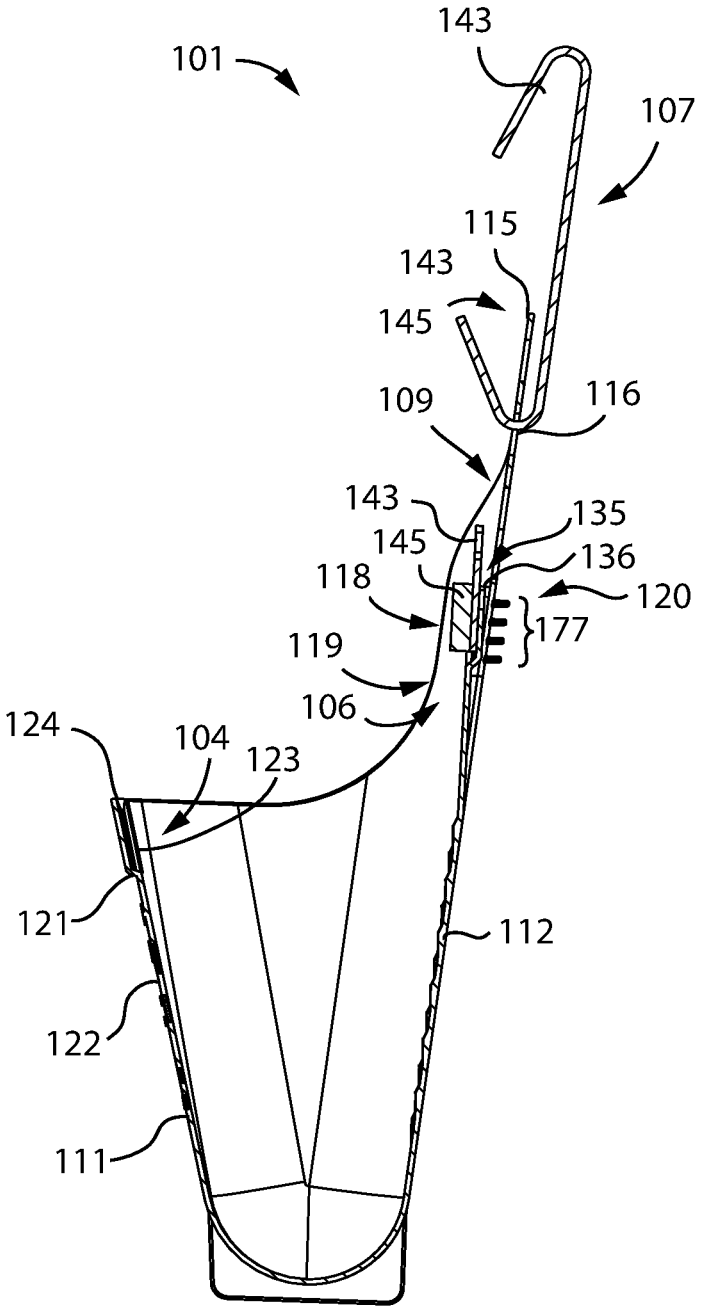
FIG. 10 is a cross-sectional view taken along line 10-10 shown in FIG. 8.
Figure 11:
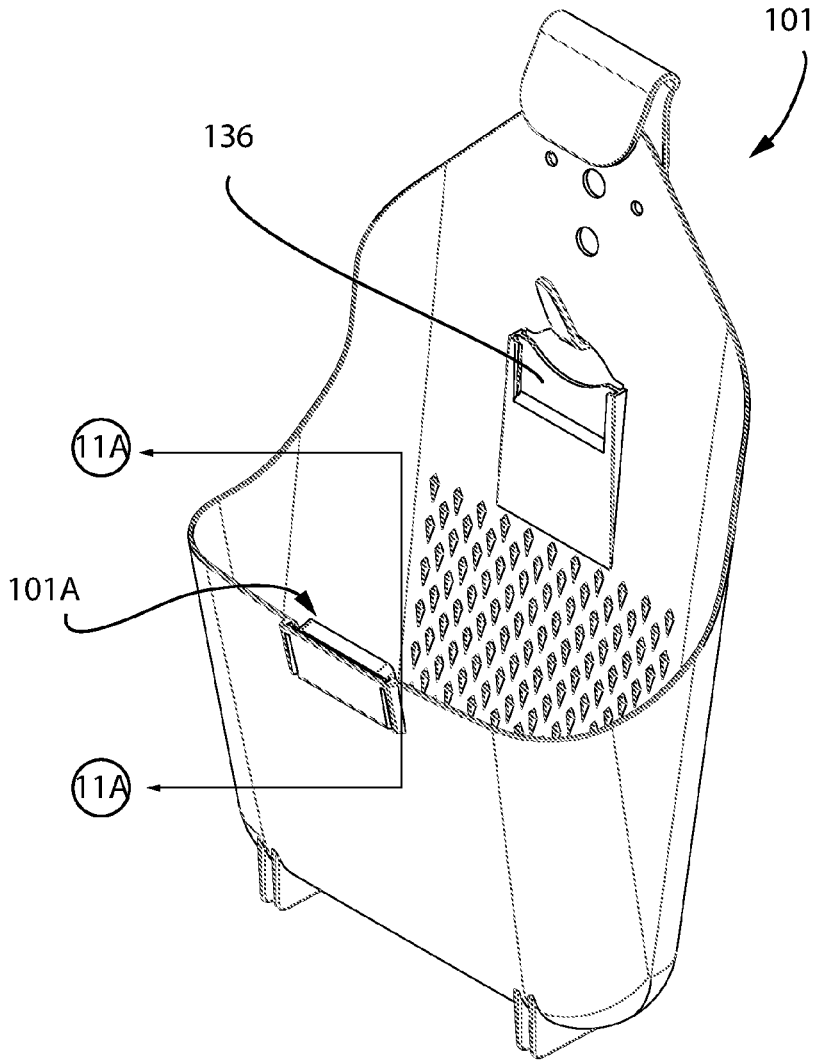
FIG. 11 is a perspective view illustrating a first coupling seated at a first receiving section, in accordance with a non-limiting exemplary embodiment.
Figure 11A:
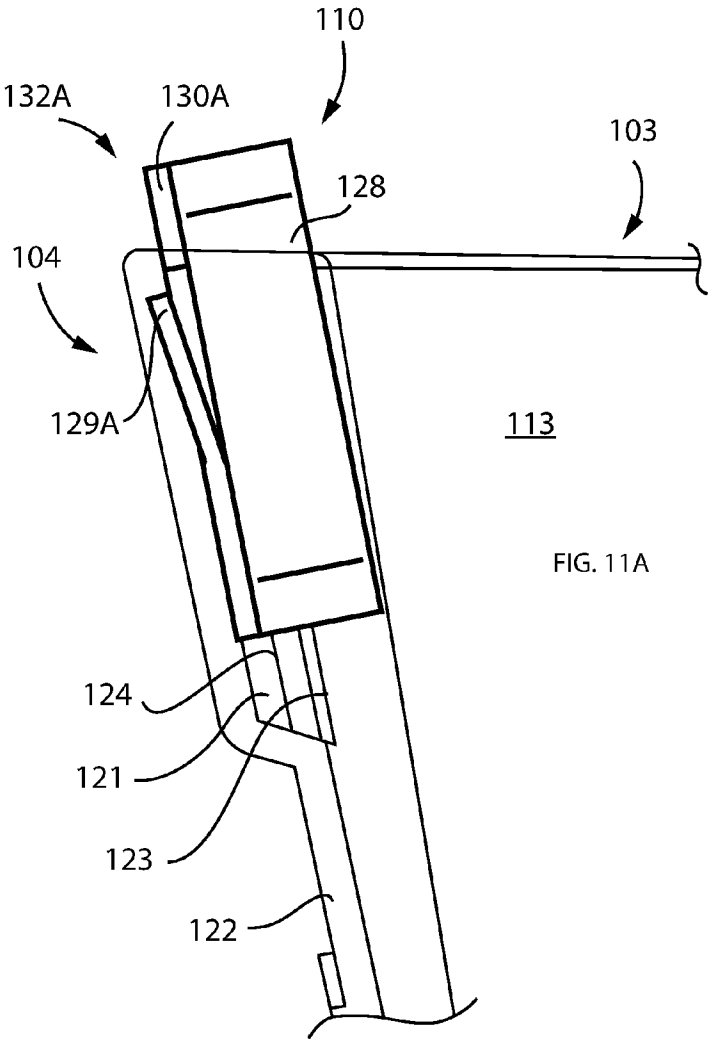
FIG. 11A is an enlarged cross-sectional view taken along line 11A-11A shown in FIG. 11.
Figure 12A:
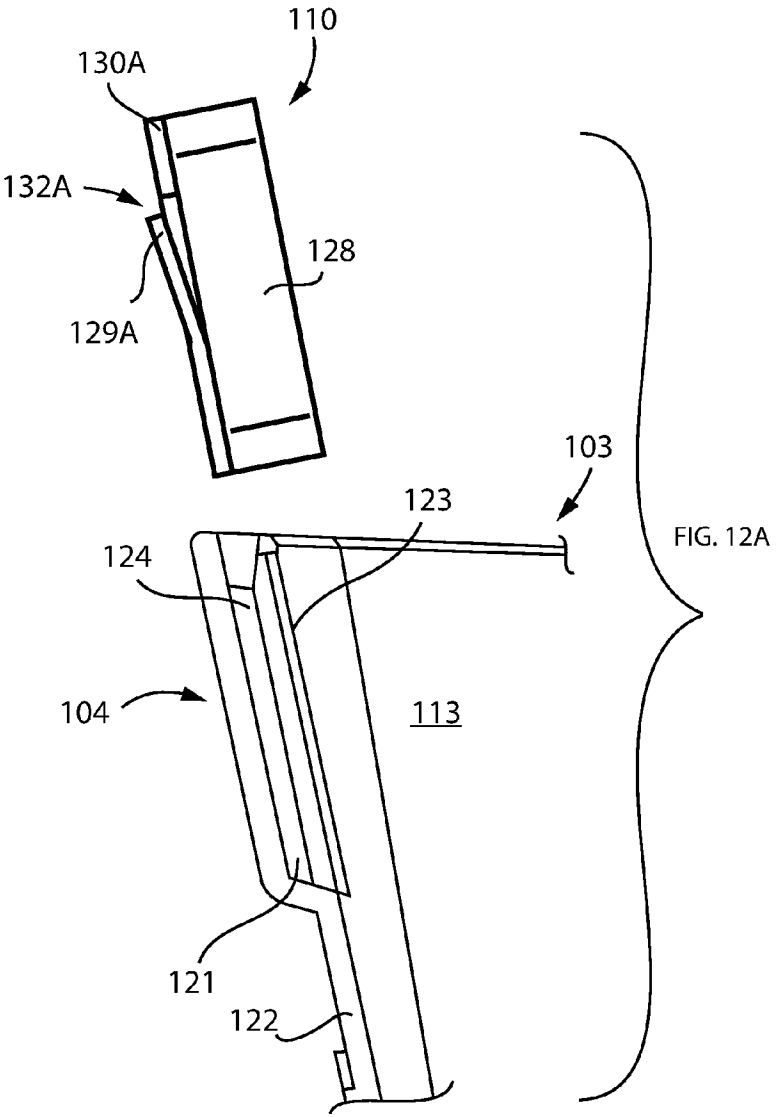
FIG. 12A is an enlarged cross-sectional view taken along line 12A-12A shown in FIG. 12.
Figure 12:
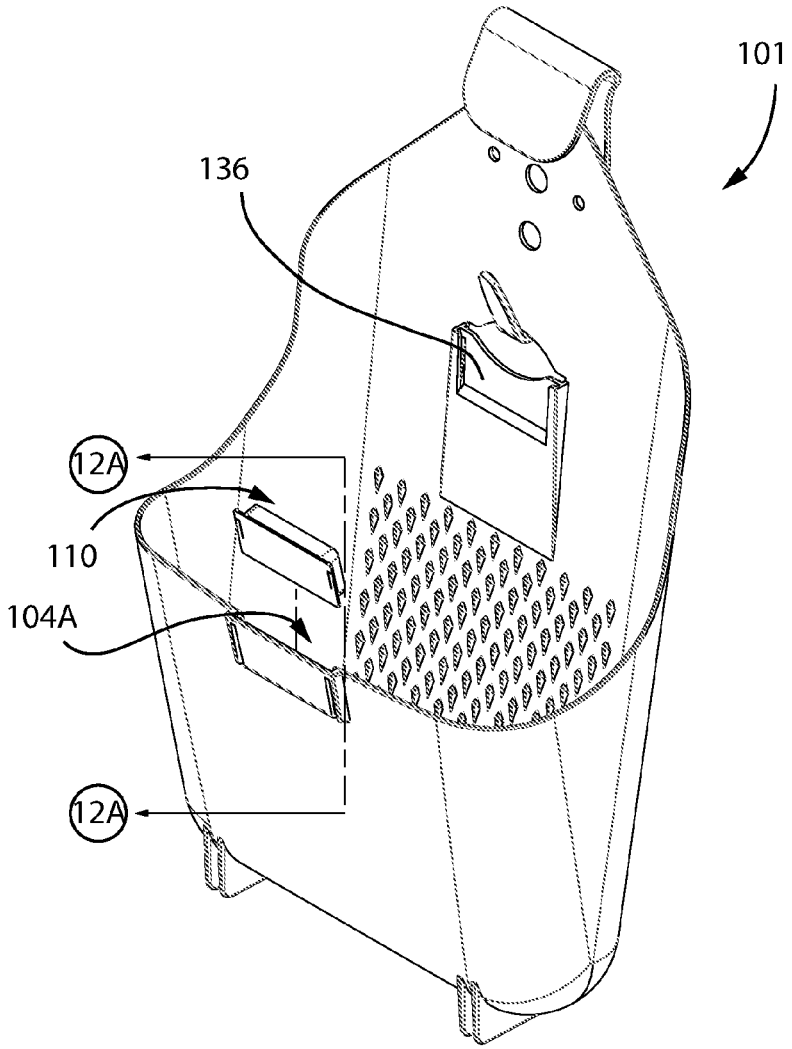
FIG. 12 is a perspective view illustrating the first coupling removed from the first receiving section shown in FIG. 11 wherein the offset flanges of the first coupling frictionally engaged with the lower linear guide shoulders of the first receiving section.
Figure 13B:
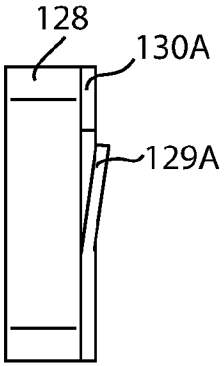
Figure 13:
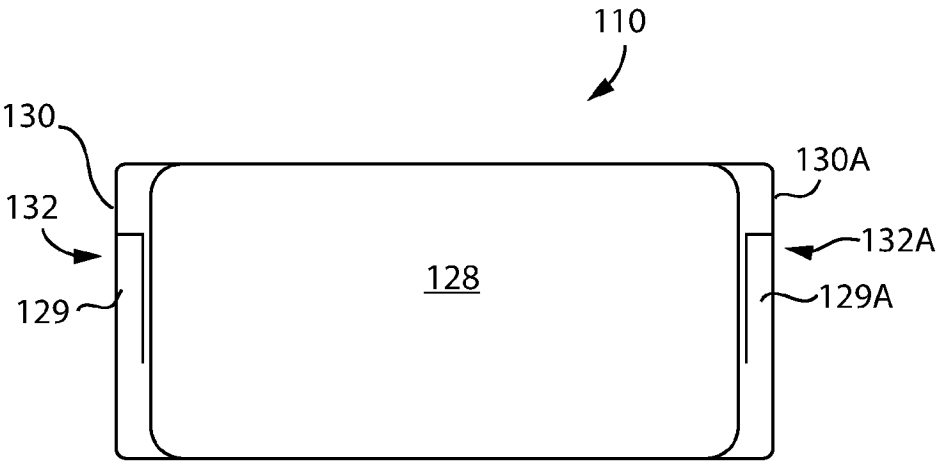
Figure 13A:
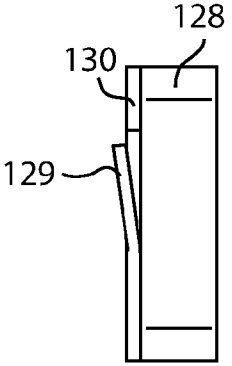
Figure 13C:
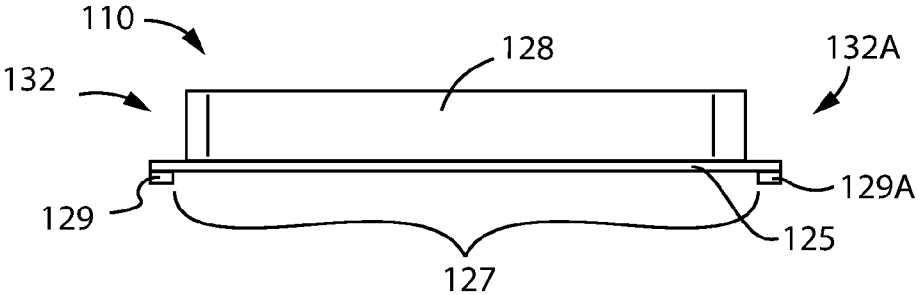
Figure 14:
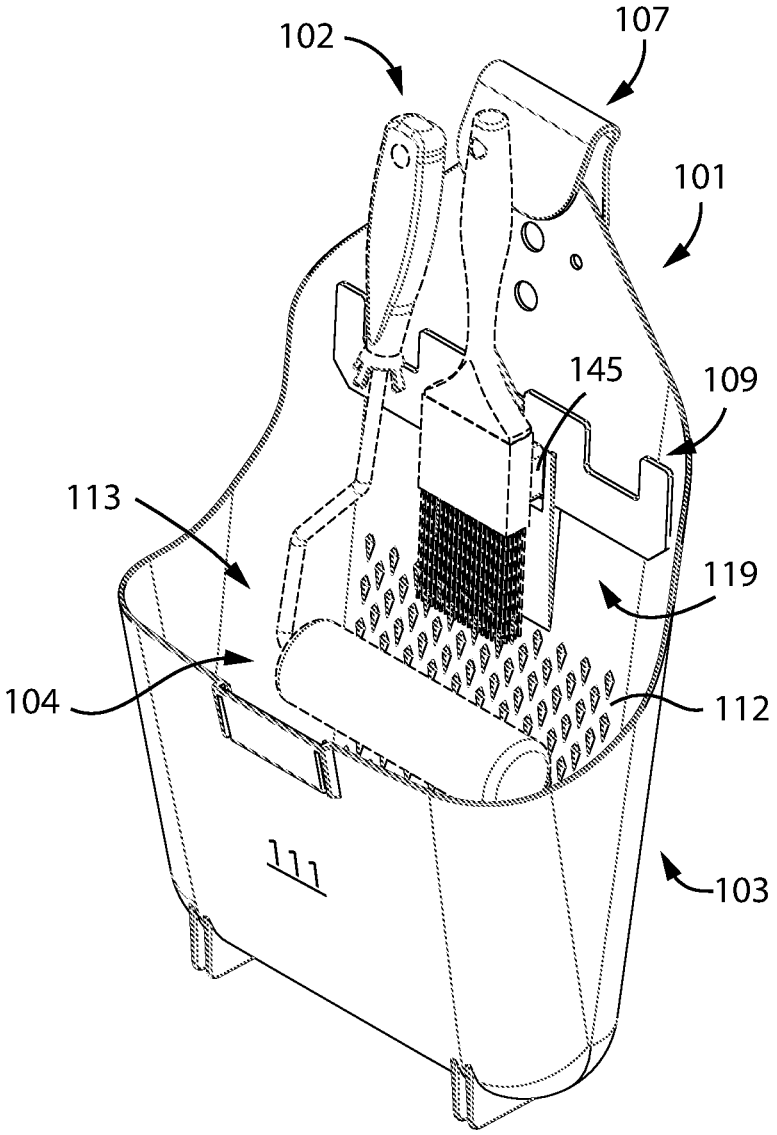
Figure 15:
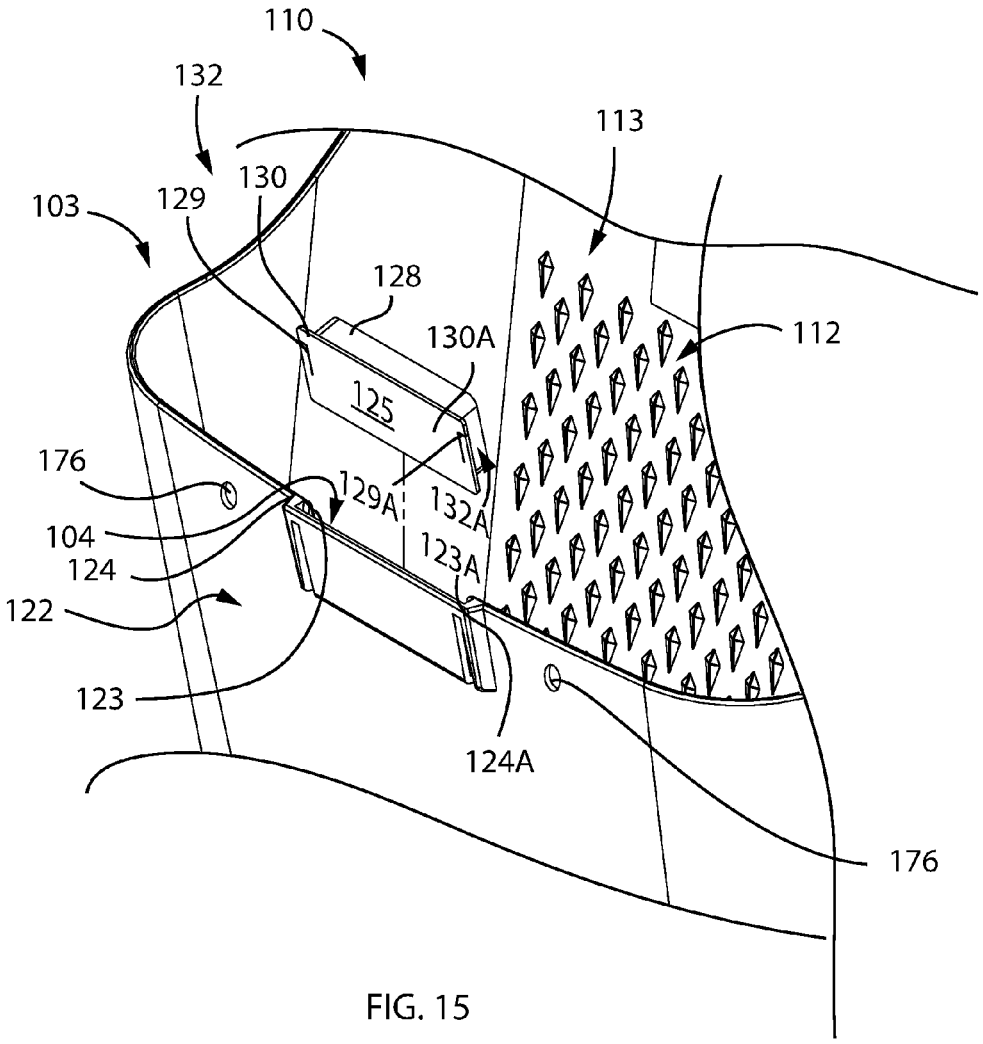
Figure 16:
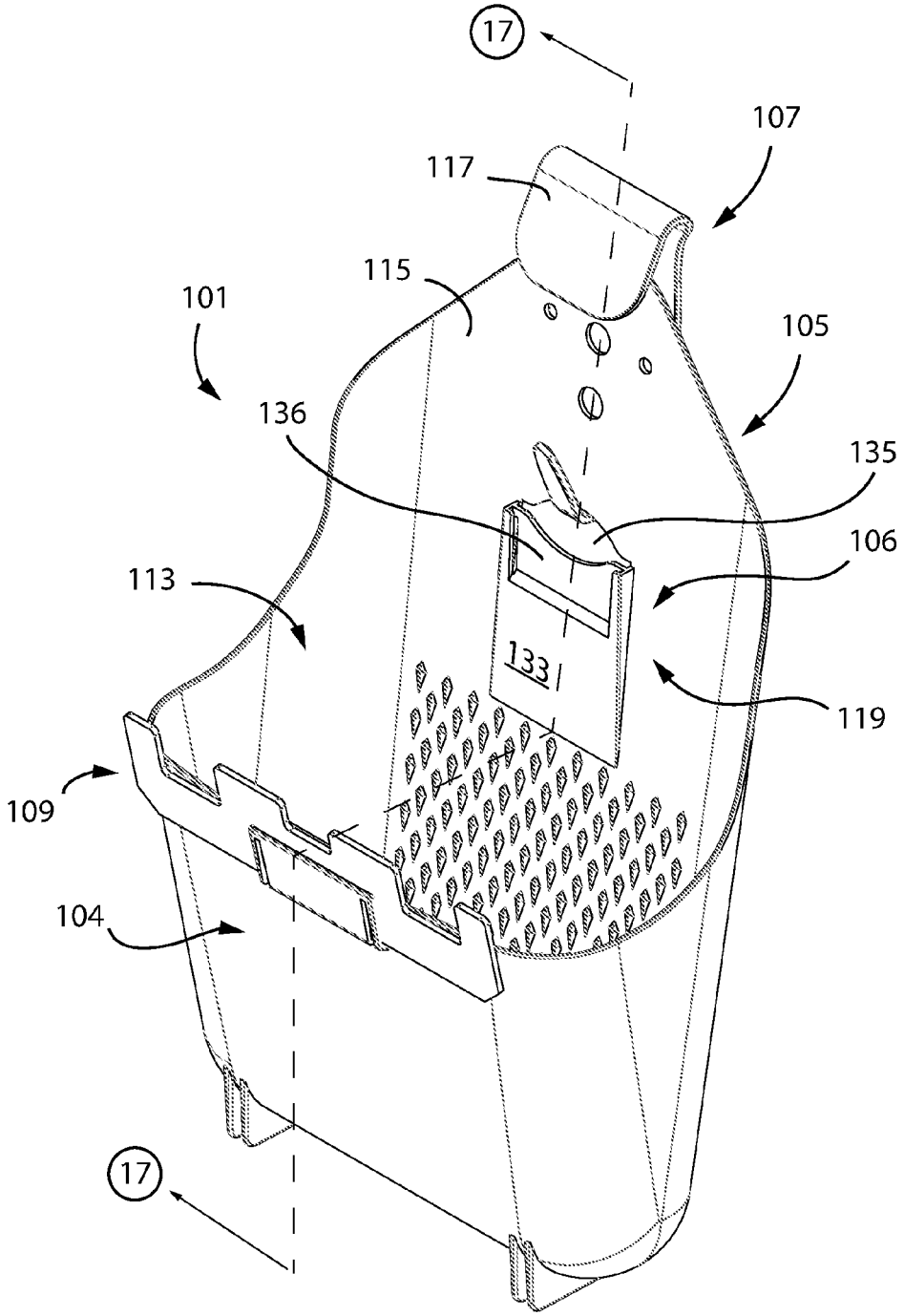
Figure 17:
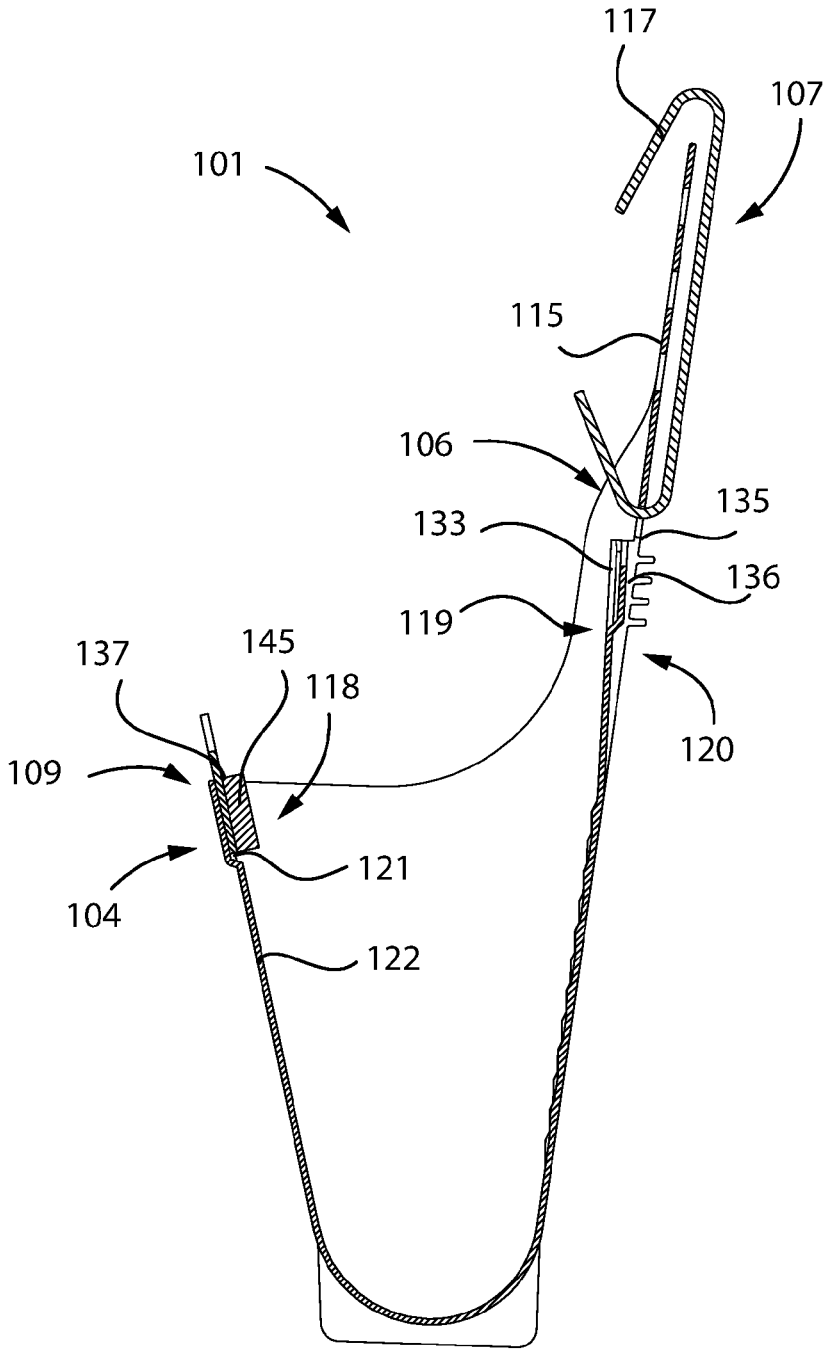
Figure 18:
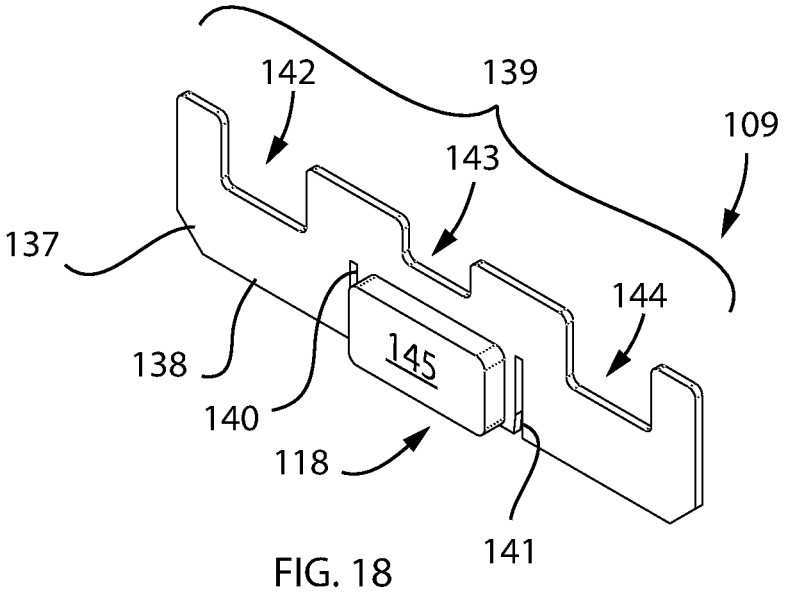
Figure 18A:
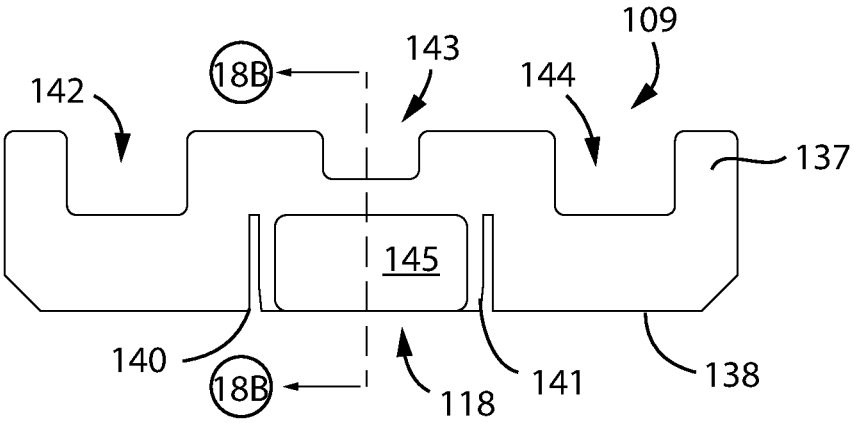
Figure 18B:
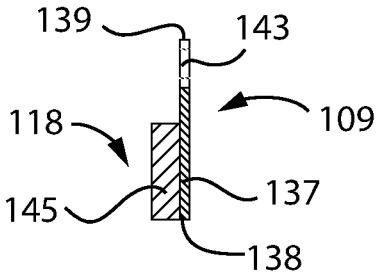

FIG. 13 a front elevational view of first coupling having a plate and a first magnet attached thereto;

FIG. 13A is a side elevational view of first coupling illustrated in FIG. 13;

FIG. 13B is a right side elevational view of first coupling illustrated in FIG. 13;

FIG. 13C is a top plan view of the first coupling illustrated in FIG. 13;

FIG. 14 is a perspective view of the embodiment shown in FIG. 11 wherein a paint brush and a roller brush are supported at the rail. Of course, all embodiments (e.g., FIG. 6 embodiment) of the present disclosure are capable of supporting objects therein;

FIG. 15 is is an enlarged partial view of FIG. 12 illustrating the offset flanges of the plate associated with the first coupling;

FIG. 16 is a perspective view illustrating the rail and second coupling removably seated at the first receiving section;

FIG. 17 is a cross-sectional view taken along line 17-17 shown in FIG. 16;

FIG. 18 is a perspective view of the rail and second coupling affixed thereto;

FIG. 18A is a front-elevational view of the rail and second coupling shown in FIG. 18; and FIG. 18B is a cross-sectional view taken along line 18B-18B in FIG. 18A.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

Select non-limiting exemplary embodiment(s) is/are referred to generally in FIGS. 1-5 and is/are intended to provide a portable utility storage apparatus 10. It should be understood that the exemplary embodiment may be used to provide a ready supply of many different types of paints and may be used to facilitate painting, and should not be limited to any particular paint described herein.

Referring initially to FIGS. 1-5 in general, a portable utility storage apparatus 10 including a lower portion 11 defining a cavity 13 adapted to hold the existing paint therein. Such a lower portion 11 includes a plurality of fasteners 14, and a lower paint brush holder 15. The apparatus 10 further includes an upper portion 12 adapted to hold the existing paint brush 21 thereat wherein the upper portion 12 is adjustably coupled to an exterior of the lower portion 11. In particular, the upper portion 12 includes a plurality of oppositely spaced lateral flanges 16 removably connected to the fasteners 14 in such a manner that the upper portion 12 remains positioned exterior of the cavity 13. The upper portion 12 also includes an upper paint brush holder 17. A belt clip 38 is detachably coupled to the upper and lower portion 12, 11 for enabling a user to support the apparatus 10 on a user's waist belt, for example.

In a non-limiting exemplary embodiment, the upper paint brush holder 17 includes a plurality of linear upper guide rails 18 attached to an anterior wall 19 of the upper portion 12 thereby facing towards the cavity 13. The upper paint brush holder 17 further includes a plate 22 and a magnet 23 coupled thereto. Such a plate 22 is removably connected to the upper portion 12 and intermediately located between the linear upper guide rails 18 such that the magnet 23 faces towards the cavity 13.

In a non-limiting exemplary embodiment, the lower paint brush holder 15 includes a plurality of linear lower guide rails 21 attached to an anterior wall 29 of the lower portion 11 thereby facing away from the cavity 13. The lower portion 11 further includes a plate 32 and a magnet 33 coupled thereto. Such a plate 32 is selectively connected to the lower portion 11 and intermediately located between the linear lower guide rails 21 such that the magnet 33 faces away from the cavity 13.

In a non-limiting exemplary embodiment, the lower portion 11 further includes a plurality of protrusions 25 located at a posterior wall 26 thereof and extending within the cavity 13. The lower portion 11 further includes a brush scraper 27 located at the posterior wall 26 such that the brush scraper 27 is juxtaposed above the protrusions 25.

In a non-limiting exemplary embodiment, the lower paint brush holder 15 further includes a rag-holding hook 28 statically connected to one of the linear lower guide rails 21 and thereby the rag-holding hook 28 is located exterior of the cavity 13.

In a non-limiting exemplary embodiment, the stationary fasteners 14 include a first pair of pins 14*a* coupled to an upper region of laterally opposed side walls 31 of the lower portion 11, and a second pair of pins 14*b* coupled to a lower region of the laterally opposed side walls 31 of the lower portion 11.

In a non-limiting exemplary embodiment, the belt clip 38 is spaced from the lower portion 11 when the lateral flanges 16 are affixed to the first pair of pins 14*a*. Such a position may be considered a lowered positioned of the upper portion 12.

In a non-limiting exemplary embodiment, the belt clip 38 is simultaneously attached to the upper and lower portion 12, 11 when the lateral flanges 16 are affixed to the second pair of pins 14*b*. Such a position may be considered a raised positioned of the upper portion 12.

The present disclosure further includes a method of utilizing a portable utility storage apparatus 10 for use with an existing paint brush 21 and existing paint. Such a method includes the chronological steps of: providing a lower portion 11 defining a cavity 13 adapted to hold the existing paint therein, wherein the lower portion 11 includes a plurality of fasteners 14, and a lower paint brush holder 15; and providing and adjustably coupling an upper portion 12 to an exterior of the lower portion 11 wherein the upper portion 12 is adapted to hold the existing paint brush 21 thereat. Such an upper portion 12 includes an upper paint brush holder 17 and a plurality of oppositely spaced lateral flanges 16 removably connected to the fasteners 14 in such a manner that the upper portion 12 remains positioned exterior of the cavity 13. The method further includes the chronological step of: providing and detachably coupling a belt clip 38 to the upper and lower portions 12, 11.

Now referring to FIGS. 6-18B, additional non-limiting exemplary embodiment(s) are illustrated as including a portable utility storage apparatus 101 for supporting an object 102 (e.g., paint, paint brush, roller brush, hammer, nails, soda can, food, etc. The portable utility storage apparatus 101 includes a lower portion 103 having a first receiving section 104, and an upper portion 105 contiguously formed with the lower portion 103 wherein the upper portion 105 has a second receiving section 106 oppositely spaced from the first receiving section 104. A clip 107 is selectively and removably engaged with the upper portion 105 in such a manner that the first receiving section 104 and the second receiving section 106 freely and synchronously oscillate (e.g., rotate, articulate, pivot, etc.) along opposite rotational directions 165, 166 (e.g., clockwise and counter clockwise) about a fulcrum axis 108 defined substantially perpendicular to the upper portion 105. As an option, the clip 107 may be positioned through channel 135 as well.

Notably, a rail 109 is removably attached to one of the first receiving section 104 and the second receiving section 106. In this manner, the rail 109 is interchangeably engaged with the first receiving section 104 and the second receiving section 106. As will be appreciated by those skilled in the art, the rail 109 may be located at either the first receiving section 104 or second receiving section 106. Furthermore, a first coupling 110 is removably attached to another one of the first receiving section 104 and the second receiving section 106. In this manner, the first coupling 110 is interchangeably engaged with the first receiving section 104 and the second receiving section 106. As will be appreciated by those skilled in the art, the first coupling 110 may be located at either the first receiving section 104 or second receiving section 106. Advantageously, the first coupling 110 is spaced from the rail 109 thereby enabling a user to separately support objects 102 at the portable utility storage apparatus 101.

In a non-limiting exemplary embodiment, the lower portion 103 includes a lower front wall 111 and a lower rear wall 112 contiguously formed therewith. Thus, a cavity 113 is disposed between the lower front wall 111 and the lower rear wall 112 wherein the first receiving section 104 is located proximate to the cavity 113. In this manner, the cavity 113 is adapted to receive at least a portion of the object 102 therein.

In a non-limiting exemplary embodiment, the lower portion 103 further includes a plurality of friction-inducing members 114 located at an anterior face of the lower rear wall 112 such that the friction-inducing members 114 are seated within the cavity 113. Such friction-inducing members 114 may be raised protrusions, recessed depressions, randomly spaced, uniformly spaced, permanently affixed, detachable, etc. Thus, if paint is retained in cavity 113, excess paint from a paint brush and/or paint roller 102 can be selectively removed as needed by rubbing same against the friction-reducing members 114.

In a non-limiting exemplary embodiment, the upper portion 105 includes an upper rear wall 115 extending upwardly from the lower rear wall 112 such that the upper rear wall 115 is disposed above the cavity 113. A plurality of apertures 116 are formed in the upper rear wall 115 and registered above the second receiving section 106 wherein the second receiving section 106 is located at the upper rear wall 115 and disposed above the first receiving section 104 relative to the cavity 113.

In a non-limiting exemplary embodiment, the clip 107 is selectively and removably engaged with the apertures 116 in such a manner that a top end 117 of the clip 107 folds down and over a top edge 139 of the upper rear wall 115.

In a non-limiting exemplary embodiment, one or more finger holes 175 are formed in the upper portion 105 for receiving a user's finger therethrough thereby enabling the user to easily transport the apparatus 10 between remote locations. Also, one or more bracket holes 176 at the lower portion 103 are provided for receiving a bracket or similar support member, as needed.

In a non-limiting exemplary embodiment, the portable utility storage apparatus 101 further includes a second coupling 118 spaced from the first coupling 110 and attached to the rail 109. In a non-limiting exemplary embodiment, the second coupling 118 includes a second magnet 145. Notably, the second receiving section 106 has an anterior side 119 facing towards the first receiving section 104. Conversely, the second receiving section 106 has a posterior side 120 facing away from the first receiving section 104.

In a non-limiting exemplary embodiment, the second coupling 118 is juxtaposed anterior to the upper rear wall 115 when the rail 109 is located at the anterior side 119 of the second receiving section 106 such that the rail 109 is intercalated between the upper rear wall 115 and the second coupling 118.

In a non-limiting exemplary embodiment, the first receiving section 104 includes a groove 121 integrally formed with the lower portion 103. Such a groove 121 is offset from a plane 122 of the lower front wall 111. A plurality of lower linear guide shoulders 123, 123A are spaced apart at lateral edges 124, 124A of the groove 121 wherein the lower linear guide shoulders 123, 123A extend medially towards a center of the groove 121.

In a non-limiting exemplary embodiment, the first coupling 110 includes a plate 125 having a planar central region 127, and a first magnet 128 coupled to the planar central region 127 wherein the plate 125 includes a plurality of deformable flanges 129, 129A laterally spaced at opposed edges 130, 130A thereof. Such deformable flanges 129, 129A are registered adjacent to opposed ends of the first magnet 128 wherein the deformable flanges 129, 129A are selectively offset from the planar central region 127 and registered along mutually exclusive paths 132, 132A, respectively, and thereby registered non-planar to the planar central region 127. Advantageously, such deformable flanges 129, 129A are frictionally engaged with the lower linear guide shoulders 123, 123A when the plate 125 is seated at the groove 121.

In a non-limiting exemplary embodiment, the second receiving section 106 includes a first wall 133 located at the anterior side 119 thereof and angularly extends upwards and away from the upper rear wall 115. A second wall 134 is located at the posterior side 120 thereof and angularly extends upwards and away from the upper rear wall 115. A channel 135 is formed between the first wall 133 and the second wall 134. A planar divider member 136 is interfitted within the channel 135 such that the anterior side 119 of the second receiving section 106 is bifurcated from the posterior side 120 of the second receiving section 106. One or more ribs 177 may extend rearwardly from anterior side 119 for providing a buffer between the upper rear wall 115 and a surface against which the apparatus 101 is engaged.

In a non-limiting exemplary embodiment, the rail 109 includes a body 137 having a bottom edge 138 and a top edge 139 opposed therefrom. A plurality of juxtaposed parallel slits 140, 141 extend upwardly from the bottom edge 138 of the body 137, and a plurality of juxtaposed notches 142-144 extend downwardly from the top edge 139 of the body 137. Notably, the second coupling 118 is intermediately positioned between the parallel slits 140, 141.

In a non-limiting exemplary embodiment, the second coupling 118 faces towards the cavity 113 when the parallel slits 140, 141 are engaged with the first wall 133 and the rail 109 is registered anterior to the divider member 136 such that the notches 142-144 are positioned at the anterior side 119 of the second receiving section 106.

It is noted that the rail 109 and second coupling 118 may be affixed together via adhesive or another suitable fastener. Similarly, the plate 125 and second magnet 128 are adhesively affixed together. Advantageously, the rail 109 and second coupling 118 are removably attached to each of the first receiving section 104 and second receiving section 106. Likewise, the first coupling 110 is removably attached to each of the first receiving section 104 and second receiving section 106. Thus, the rail 109, first coupling 110 and second coupling 118 can be simultaneously and interchangeably engaged with the first receiving section 104 and second receiving section 106. Nothing in the present disclosure should be construed as limiting the rail 109, first coupling 110 and second coupling 118 from being simultaneously and interchangeably employed in one or more embodiments described herein.

The present disclosure further includes a method of utilizing a portable utility storage apparatus 101 for supporting an object 102 thereat. Such a method includes the steps of: providing a lower portion 103 having a first receiving section 104; providing an upper portion 105 contiguously formed with the lower portion 103 wherein the upper portion 105 has a second receiving section 106 oppositely spaced from the first receiving section 104; providing and removably attaching a rail 109 to one of the first receiving section 104 and the second receiving section 106; providing and removably attaching a first coupling 110 to another one of the first receiving section 104 and the second receiving section 106 such that the first coupling 110 is spaced from the rail 109; providing a clip 107; selectively and removably engaging the clip 107 with the upper portion 105; and freely and synchronously oscillating (e.g., rotate, articulate, pivot, etc.) along opposite rotational directions 165, 166 (e.g., clockwise and counter clockwise) the first receiving section 104 and the second receiving section 106 about a fulcrum axis 108 defined substantially perpendicular to the upper portion 105.

In a non-limiting exemplary embodiment, the present disclosure may include a combined portable utility storage is a specially designed painting accessory comprised of a handy storage pouch, designed to be worn on one's belt and inside of which a fresh supply of paint and a paint brush can be neatly stored and easily accessed. The portable utility storage may be manufactured of a heavy duty rigid plastic or comparable material.

In a non-limiting exemplary embodiment, measuring approximately 9 inches in width at its widest point, the portable utility storage may be generally rectangular in shape, with an elongated, rectangular shaped loop-style reservoir centrally positioned at the top of the apparatus. The total length of the apparatus from this open reservoir to the base of the portable utility storage may measure approximately 15.5 inches. Designed to be folded over on itself for use in securing apparatus to a swivel belt loop or tool belt, this reservoir-attachment may be secured in place via a set of self-affixing fasteners appropriately positioned on the base and top of the reservoir. The upper portion of the portable utility storage would feature rounded corners, while the base of the unit may feature a tapered lip and angled corners.

In a non-limiting exemplary embodiment, positioned on the front of the portable utility storage is a paint reservoir brush reservoir. This leak proof reservoir may feature a trapezoid shape, with the top and bottom of the reservoir running parallel and the vertical side walls of the reservoir tapering inwards at an angle. Measuring approximately 4.75 inches in depth at the top of the apparatus, the reservoir may be angled inwards towards the bottom of the apparatus. A reinforced tapered lip may run along the mouth of the apparatus for use in scraping excess paint from one's brush.

In a non-limiting exemplary embodiment, the user may fill the integrated reservoir with the designated paint needed to complete a specific task. The user may then secure the portable utility storage to their tool belt or belt loop via the self-affixing loop-style reservoir positioned at the top of the apparatus. Thus properly applied, the portable utility storage may rest comfortably against the hip. The user may then simply dip their paint brush into the filled reservoir, scraping off excess paint on the reservoir's tapered lip as it is removed. This process may be repeated until the user had utilized all of the paint stored within, or the designated painting task was complete.

In a non-limiting exemplary embodiment, the portable utility storage enables consumers to store and access paint and a paint brush when completing a number of painting tasks. Designed to be easily secured to any belt or belt loop and boasting an integrated reservoir sized appropriately to accommodate 80 ounces (e.g., greater than ½ gallon) of paint and a paint brush, the portable utility storage enables the user to complete delicate trim work, paint along window sills and door frames without having to repeatedly revisit a paint bucket simply in order to reload their brush. Sparing the user the tedium of repeatedly climbing up and down off a ladder to access a paint bucket, or walk back and forth to a work station to access a fresh supply of paint, use of this handy apparatus may make the task of painting significantly less taxing and easier to complete.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A portable utility storage apparatus for supporting an object thereat, said portable utility storage apparatus comprising:

a lower portion having a first receiving section;

an upper portion contiguously formed with said lower portion, said upper portion having a second receiving section oppositely spaced from said first receiving section;

a clip selectively and removably engaged with said upper portion in such a manner that said first receiving section and said second receiving section freely and synchronously oscillate about a fulcrum axis defined substantially perpendicular to said upper portion;

a rail interchangeably engaged with said first receiving section and said second receiving section; and a first coupling interchangeably engaged with said first receiving section and said second receiving section.

2. A portable utility storage apparatus for supporting an object thereat, said portable utility storage apparatus comprising:

a lower portion having a first receiving section;

an upper portion contiguously formed with said lower portion, said upper portion having a second receiving section oppositely spaced from said first receiving section;

a clip selectively and removably engaged with said upper portion in such a manner that said first receiving section and said second receiving section freely and synchronously oscillate about a fulcrum axis defined substantially perpendicular to said upper portion;

a rail removably attached to one of said first receiving section and said second receiving section; and a first coupling removably attached to another one of said first receiving section and said second receiving section;

wherein said first coupling is spaced from said rail.

3. The portable utility storage apparatus of claim 2, wherein said lower portion comprises:

a lower front wall and a lower rear wall contiguously formed therewith; and a cavity disposed between said lower front wall and said lower rear wall;

wherein said first receiving section is located proximate to said cavity;

wherein said cavity is adapted to receive at least a portion of the object.

4. The portable utility storage apparatus of 3, wherein said lower portion further comprises:

a plurality of friction-inducing members located at an anterior face of said lower rear wall such that said friction-inducing members are seated within said cavity.

5. The portable utility storage apparatus of claim 3, wherein said upper portion comprises:

an upper rear wall extending upwardly from said lower rear wall such that said upper rear wall is disposed above said cavity; and a plurality of apertures formed in said upper rear wall and registered above said second receiving section;

wherein said second receiving section is located at said upper rear wall and disposed above said first receiving section relative to said cavity.

6. The portable utility storage apparatus of claim 5, wherein said clip is selectively and removably engaged with said apertures in such a manner that a top end of said clip folds down and over a top edge of said upper rear wall.

7. The portable utility storage apparatus of claim 6, further comprising:

a second coupling spaced from said first coupling and attached to said rail;

wherein said second receiving section has an anterior side facing towards said first receiving section;

wherein said second receiving section has a posterior side facing away from said first receiving section.

8. The portable utility storage apparatus of claim 7, wherein said second coupling is juxtaposed anterior to said upper rear wall when said rail is located at said anterior side of said second receiving section such that said rail is intercalated between said upper rear wall and said second coupling.

9. The portable utility storage apparatus of claim 8, wherein said first receiving section comprises:

a groove integrally formed with said lower portion, said groove being offset from a plane of said lower front wall; and a plurality of lower linear guide shoulders spaced apart at lateral edges of said groove, said lower linear guide shoulders extending medially towards a center of said groove.

10. The portable utility storage apparatus of claim 9, wherein said first coupling comprises:

a plate having a planar central region; and a first magnet coupled to said planar central region;

wherein said plate includes a plurality of deformable flanges laterally spaced at opposed edges thereof, said deformable flanges being registered adjacent to opposed ends of said first magnet;

wherein said deformable flanges are selectively offset from said planar central region and registered along mutually exclusive paths, respectively, thereby registered non-planar to said planar central region;

wherein deformable flanges are frictionally engaged with said lower linear guide shoulders when said plate is seated at said groove.

11. The portable utility storage apparatus of claim 7, wherein said second receiving section comprises:

a first wall located at said anterior side and angularly extending upwards and away from said upper rear wall;

a second wall located at said posterior side and angularly extending upwards and away from said upper rear wall;

a channel formed between said first wall and said second wall; and a planar divider member interfitted within said channel such that said anterior side of said second receiving section is bifurcated from said posterior side of said second receiving section.

12. The portable utility storage apparatus of claim 11, wherein said rail comprises:

a body having a bottom edge and a top edge opposed therefrom;

a plurality of juxtaposed parallel slits extending upwardly from said bottom edge of said body; and a plurality of juxtaposed notches extending downwardly from said top edge of said body;

wherein said second coupling is intermediately positioned between said parallel slits.

13. The portable utility storage apparatus of claim 12, wherein said second coupling faces towards said cavity when said parallel slits are engaged with said first wall and said rail is registered anterior to said divider member such that said notches are positioned at said anterior side of said second receiving section.

14. The portable utility storage apparatus of claim 13, wherein said second coupling comprises: a second magnet.

15. A method of utilizing a portable utility storage apparatus for supporting an object thereat, said method comprising the steps of:

providing a lower portion having a first receiving section;

providing an upper portion contiguously formed with said lower portion, said upper portion having a second receiving section oppositely spaced from said first receiving section;

providing and removably attaching a rail to one of said first receiving section and said second receiving section;

providing and removably attaching a first coupling to another one of said first receiving section and said second receiving section such that said first coupling is spaced from said rail;

providing a clip;

selectively and removably engaging said clip with said upper portion; and freely and synchronously oscillating said first receiving section and said second receiving section about a fulcrum axis defined substantially perpendicular to said upper portion.

* * * * *